US005156293A

United States Patent [19]

Petterson et al.

[11] Patent Number: 5,156,293

[45] Date of Patent: Oct. 20, 1992

[54] FOLDED SHEET PRODUCT DISPENSER SYSTEM

[75] Inventors: Tor Petterson, Rancho Palos Verdes; Jean T. McGregor, Covina, both of Calif.

[73] Assignee: James River II, Inc., Oakland, Calif.

[21] Appl. No.: 792,638

[22] Filed: Nov. 15, 1991

Related U.S. Application Data

[62] Division of Ser. No. 667,861, Mar. 12, 1991, Pat. No. 5,100,020.

[51] Int. Cl.[5] ..... B65D 45/16

[52] U.S. Cl. ..... 220/326

[58] Field of Search ..... 220/324, 326

[56] References Cited

U.S. PATENT DOCUMENTS

| | | | |
|---|---|---|---|
| 832,284 | 10/1906 | White | 220/326 X |
| 895,124 | 8/1908 | Sundee | 220/326 |
| 1,069,299 | 8/1913 | Sundee | 220/326 |
| 1,119,804 | 12/1914 | Brown | 220/326 X |
| 1,485,050 | 2/1924 | Phillips | 220/326 |
| 1,975,173 | 10/1934 | Pennock et al. | 220/326 X |
| 2,090,886 | 8/1937 | Dion | 220/326 X |
| 2,740,055 | 4/1956 | Irelan | 220/326 |
| 3,175,853 | 3/1965 | Gilbertson | 220/326 X |
| 3,281,936 | 11/1966 | Haan et al. | 220/326 X |
| 4,774,973 | 10/1988 | Gueret | 220/326 |

*Primary Examiner*—Stephen Marcus
*Assistant Examiner*—Stephen Cronin
*Attorney, Agent, or Firm*—Thomas R. Lampe

[57] ABSTRACT

A dispenser apparatus for serially dispensing products such as paper napkins from a stack of such products. The dispenser apparatus includes a housing having a back wall which is curved and has a radius of curvature generally corresponding to the radius of curvature of the stack.

4 Claims, 3 Drawing Sheets

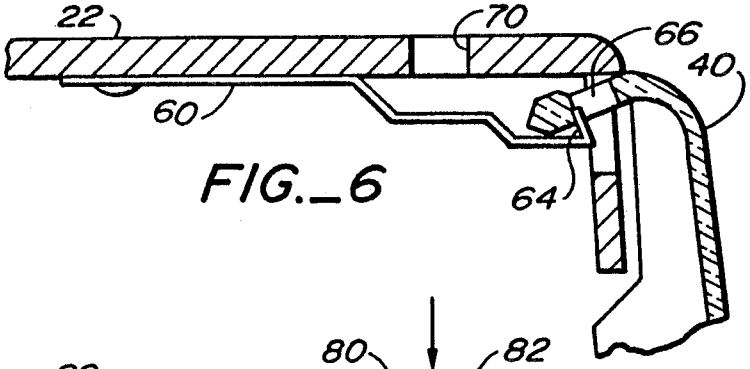
FIG._6
FIG._6A
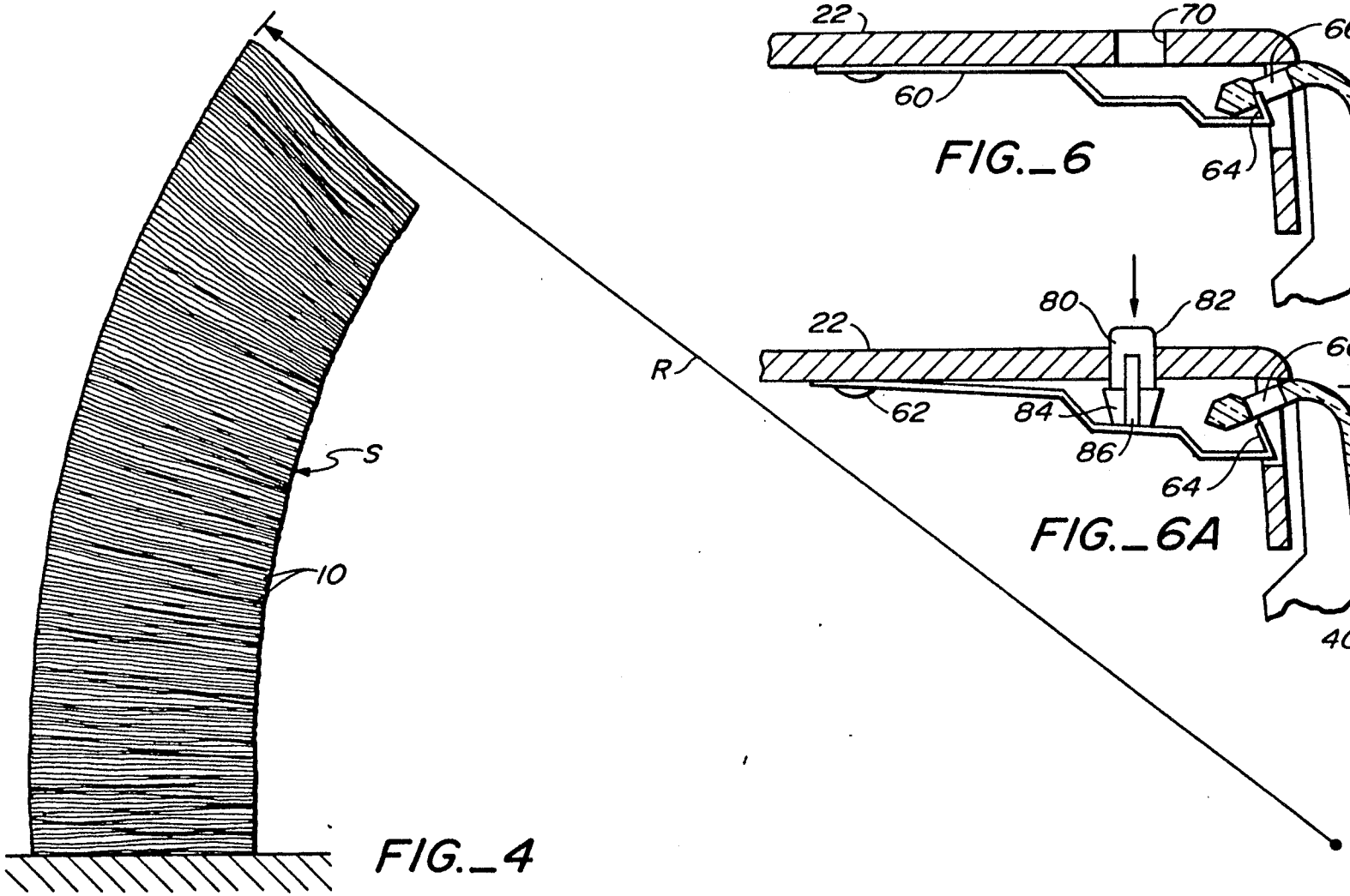
FIG._4

FOLDED SHEET PRODUCT DISPENSER SYSTEM

This is a continuation of application Ser. No. 07/667,861 filed Mar. 12, 1991 now U.S. Pat. No. 5100020.

TECHNICAL FIELD

This invention relates to dispenser apparatus for serially dispensing discrete folded sheet products, such as paper napkins, from a stack of said folded sheet products. More particularly, the dispenser apparatus includes a housing of specified construction which provides for improved presentation of the products at the point of dispensing, facilitates such dispensing, and utilizes storage space in a highly efficient manner.

BACKGROUND ART

It is well known to serially dispense folded sheet products such as paper napkins from a stack of such products. Such dispensers can employ followers or simply be gravity fed; the latter approach generally being the lowest cost and least complex.

In the case of gravity-fed dispensers for paper napkins and the like, the products are stacked in a housing having a dispenser element or nose piece of some nature attached to the lower end of the housing and defining an opening through which the products are dispensed in a serial fashion, often merely by manual grasping and removal of the products by a consumer at the opening.

It will be appreciated that dispensing of the lowermost napkin or other folded sheet product can be inhibited by frictional forces exerted thereon by the rest of the stack. That is, the lowermost folded sheet product supports the rest of the stack. The higher the stack, the greater the frictional forces between the lowermost folded sheet product and the folded sheet product immediately adjacent thereto. Ripping and tearing of the napkin or other folded sheet product being dispensed is fairly common, particularly when the stack itself is quite long and the lowermost folded sheet product bears its entire weight.

Often, the dispenser elements of gravity-fed paper napkins and other similar dispensers are disposed essentially horizontally, meaning of course that the paper napkin or other folded sheet product being dispensed bears the full load of the stack of which it is a part. Such disposition of the dispenser element and its dispensing outlet or opening also means that the consumer may have difficulty accessing and withdrawing the lowermost paper napkin or the like.

The aforesaid difficulties found in prior art dispensers are often aggravated by the fact that the products being dispensed, such as paper napkins, are of non-uniform thickness due to the particular fold utilized in their construction. Not only can this cause uneven frictional engagement between adjacent folded sheet products, the fact that the folded sheet products are conventionally stacked in a dispenser with corresponding portions thereof in alignment means that the storage capacity of the dispenser housing is not effectively utilized. That is, a stack of such folded sheet products will tend to be higher at one side thereof than the other due to the non-uniform thickness of each individual product. To accommodate a straight, vertically disposed stack, the dispenser housing must be as high as the highest stack side.

DISCLOSURE OF INVENTION

The dispenser apparatus of the present invention is characterized by the fact that it does not suffer from the deficiencies noted above found in conventional gravity-fed paper napkin dispensers and the like. The housing of the present dispenser apparatus and the structure cooperating therewith are so constructed and cooperate in such a manner as to relieve and even out frictional forces of folded sheet products at the bottom of a stack of such products. Furthermore, the housing cooperates with an associated dispenser element in a specified manner so as to present the edge of the lowermost folded sheet product in the stack toward the consumer to facilitate manual access to and removal of the lowermost sheet product.

The dispenser apparatus of the present invention is for the purpose of serially dispensing discrete folded sheet products, such as paper napkins, from a stack of such products. Each of the folded sheet products is of non-uniform thickness an has a first edge portion thereof thicker than an second edge portion thereof whereby the folded sheet products, when stacked with the first edge portions and second edge portions in respective alignment, will in the absence of outside forces applied to the folded sheet products form a stack with a bend along the length thereof having a predetermined radius of curvature.

The present dispenser apparatus includes a generally vertically oriented housing having a front, an upper end, and a lower end, and including side walls and a back wall defining an interior for accommodating the stack of folded sheet products. The housing back wall is curved and has a radius of curvature generally corresponding to the predetermined radius of curvature noted above.

A dispenser element is connected to the lower end of the housing, the dispenser element defining an opening in communication with the housing interior for allowing manual access to and removal of the lowermost folded sheet product in the stack of folded sheet products in the housing. The first edge portions of the stacked sheet products are in free slidable engagement with the curved housing back wall during downward movement of the stack within the housing interior under the influence of gravity upon removal of the lowermost folded sheet product therefrom.

The housing back wall is generally vertically oriented at the upper end of the housing and extends generally toward the housing front at the lower end of the housing. The housing back wall supports the folded sheet products within the housing interior at the lower end of the housing at the first edge portions thereof.

The opening of the dispenser element of the dispenser apparatus is generally disposed along a plane substantially perpendicular to the housing back wall at the lower end of the housing whereby the bottom of the lowermost folded sheet product in the housing generally faces toward the housing front to facilitate manual access to the lowermost sheet product through the opening.

The present invention also encompasses an improved method for serially dispensing discrete sheet products from a stack of the folded sheet products. Furthermore, the dispenser apparatus includes improved means for supporting the housing as well as means for accommodating over-fill of the housing interior and means for modifying the latch associated with the housing and housing cover to adapt same to either fingertip actuation or actuation by a tool.

Other features, advantages, and objects of the present invention will become apparent with reference to the following description and accompanying drawings.

BRIEF DESCRIPTION OF DRAWINGS

FIG. 4 is a diagrammatic, profile view illustrating the configuration assumed by a stack of paper napkins of the type illustrated in FIG. 3;

FIG. 6 is an enlarged view of that portion of the dispenser apparatus encompassed by line 6—6 in FIG. 2 and illustrating details of the door latch employed therein in latched condition; and FIG. 6A is a view similar to FIG. 6 but illustrating the door latch in unlatched condition.

BEST MODE FOR CARRYING OUT THE INVENTION

Figure 3:
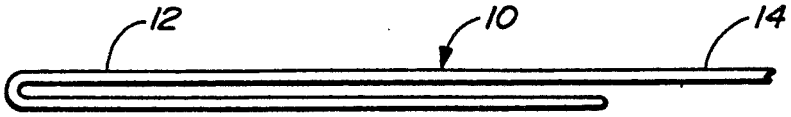
FIG. 3 is a diagrammatic view of a representative folded napkin of the type suitable for dispensing by the dispenser apparatus.

FIG. 3 illustrates diagrammatically a typical folded sheet product of the type to be dispensed by the dispenser apparatus of the present invention. In particular, the illustrated folded sheet product is a paper napkin 10. Napkin 10 is, as may clearly be seen, of non-uniform thickness having a first edge portion thereof, portion 12, thicker than a second edge portion 14 thereof. This uneven thickness simply results from the nature of the fold.

When paper napkin 10 is stacked with other paper napkins of like construction in a dispenser housing, it is usually necessary, or at least desirable, to have the first edge portions and second edge portions of all of the stacked napkins in respective alignment. These stacked napkins will, in the absence of outside forces being applied to the napkins, form a stack S, as shown in FIG. 4, with a bend along the length thereof having a predetermined radius of curvature R.

The dispenser apparatus of the present invention is designated by reference numeral 20. Apparatus 20 includes a generally vertically oriented housing 22 having a front, an upper end, and a lower end. The housing includes side walls 24, 26 and a back wall 28 defining an interior for accommodating the stack of paper napkins. In accordance with the teachings of the present invention, the housing back wall 28 is smoothly curved and has a radius of curvature generally corresponding to the radius of curvature R of the stack shown in FIG. 4.

A dispenser element 34 is connected to the lower end of the housing 22 in any suitable fashion. The dispenser element is in the form of a nose piece defining an opening 36 in communication with the housing interior. The dispenser element 34 may be of any suitable construction and dispenser elements in the form of nose pieces attached to housings are well known per se in the prior art. Opening 36, being in communication with the housing interior, allows manual access to and removal of the lowermost folded sheet product in the stack of folded sheet products in the housing.

It will be appreciated that the first edge portions 12 of the paper napkins 10 stacked in housing 22 are in free slidable engagement with the smoothly curved housing back wall 28 during downward movement of the stack within the housing interior under the influence of gravity upon removal of the lowermost folded sheet product from the dispenser apparatus.

Housing back wall 28 is generally vertically oriented at the upper end of the housing and extends generally toward the housing front at the lower end of the housing. The housing back wall supports the folded sheet products, i.e. napkins 10, within the housing interior at the lower end of the housing at the first edge portions 12 thereof.

The dispenser element opening 36 is generally disposed along a plane substantially perpendicular to the housing back wall at the lower end of the housing. Thus, the bottom of the lowermost folded sheet product in the housing generally faces toward the housing front, i.e. in the direction of the consumer, to facilitate manual access of the lowermost sheet product through the opening. Because of the curvature of the back wall at the lower end of the housing, some of the weight of the stack in such vicinity is assumed by the lower end of the back wall 28. For that matter, some weight will be carried by the back wall 28 along almost the entire length of the stack, the only exception being where the back wall 28 is substantially vertical. More of the stack weight, of course, is borne by the back wall at its lower end than at its upper end. This pressure relief has a profound effect on the paper napkins in the bottom of the stack. Because the lowermost napkin does not carry the entire weight of the stack, the frictional forces which exist between it and the paper napkin immediately disposed above it will be significantly lessened. Also, less friction will exist between the lowermost paper napkin and the dispenser element or nose piece 34. Thus, a consumer will have considerably less difficulty pulling the lowermost napkin away from the stack through the opening 36.

Another advantage of the curvature of back wall 28 resides in the fact that a greater number of paper napkins can be stacked within a specified vertical distance than would be the case if the housing was essentially straight and perpendicular. Also, of course, as has been alluded to already, the lowermost paper napkin in the stack is, by virtue of the curvature of the housing, presented in the direction of the consumer.

Figure 2:
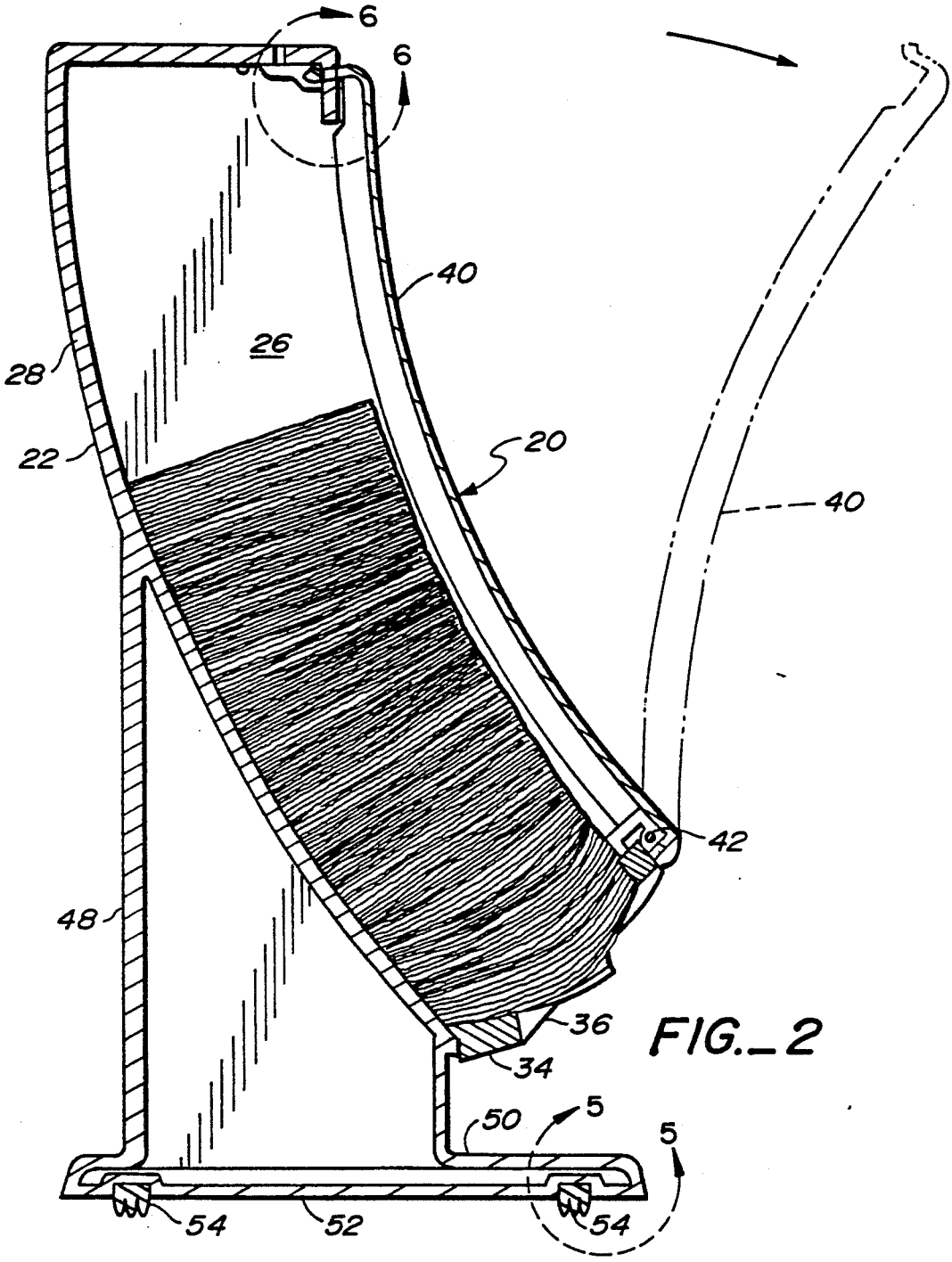
FIG. 2 is a cross-sectional, side view of the dispenser with a stack of paper napkins therein.

The illustrated dispenser apparatus 20 also includes a cover 40 hinged to the housing in a suitable manner as by hinge 42. The cover is curved and generally parallel to the housing back wall when in the closed position illustrated in solid line in FIG. 2. The phantom line presentation illustrates schematically how the cover may be pivoted away from the housing to expose the housing interior for refill or servicing.

The dispenser apparatus also includes a support 48 connected to the housing 22 for supporting the housing above a support surface. The support includes a support stand 50 having a bottom 52. Two support elements 54 constructed of a flexible material such as rubber project outwardly from the support stand bottom at spaced locations thereon. The illustrated support elements are elongated, extending from one side of the support stand to the other side thereof.

Figure 5:
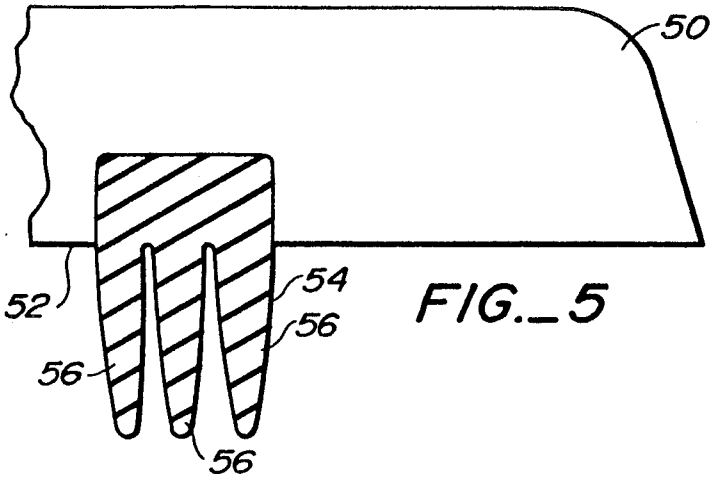
FIG. 5 is an enlarged view of that portion of the dispenser apparatus delineated by line 5—5 in FIG. 2 relating to a support element incorporated in the dispenser apparatus.
Figure 5A:
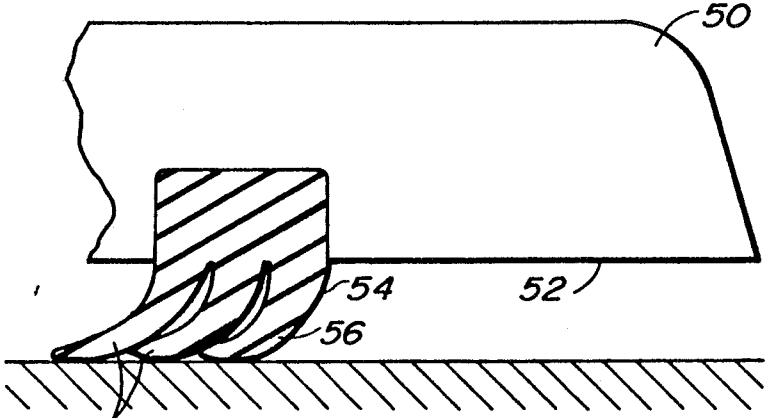
FIG. 5A is a view similar to FIG. 5, but illustrating the support element in the stressed condition assumed thereby when supporting the dispenser apparatus on a support surface.
Figure 1:
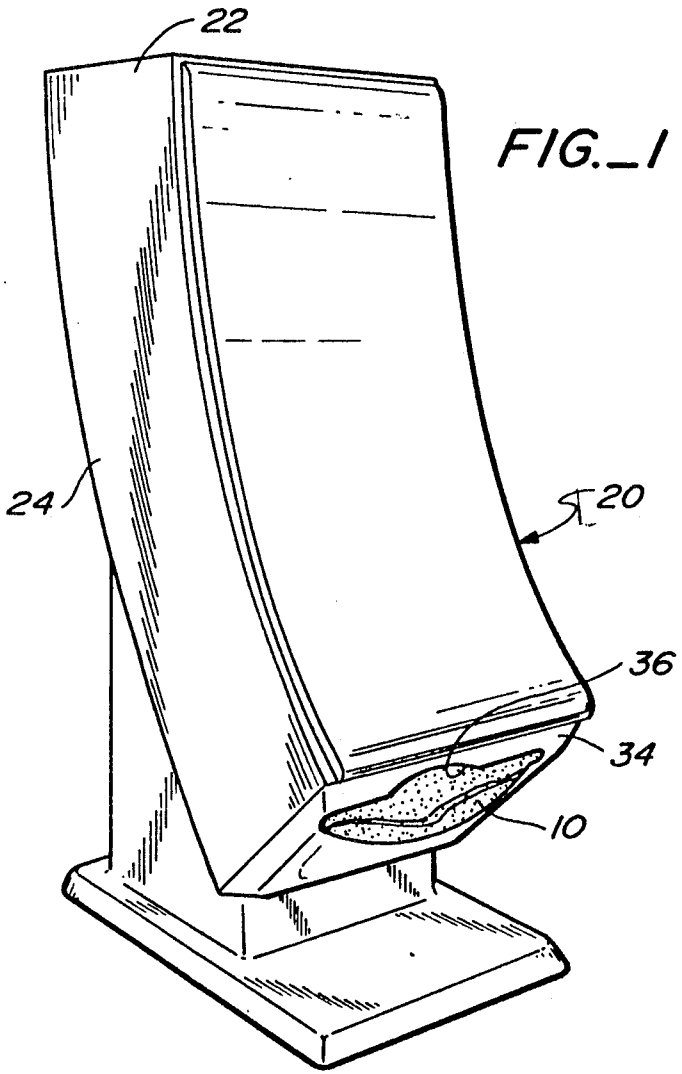
FIG. 1 is a perspective view of a preferred form of dispenser apparatus constructed in accordance with the teachings of the present invention.

Each support element 54 includes a plurality of flexible, elongated rib elements disposed side-by-side and parallel to one another. As is readily apparent from the drawing, particularly FIGS. 5 and 5A thereof, each rib element 36 has a distal end and rib element side walls. As shown in FIG. 5A, the rib elements are bent when positioned on a support surface to establish frictional engagement between the support surface and one of the rib element side walls of each rib element.

It may also be seen that adjacent rib elements are in engagement when the rib elements are bent and positioned on the support surface. Such an arrangement has been found to be highly effective in preventing relative movement between the dispenser and the support surface. It is markedly superior to the flat pad or feet arrangements often utilized in connection with paper napkin and other dispensers to support same. Paper napkin dispensers are often utilized in environments which, over time, can result in the build up of grease, dust and the like on the bottoms of the support elements, greatly adding to the propensity of the dispenser to slide relative to the support surface. The support element 54 not only presents and provides a high contact profile with the support surface, but also the flexure of the separate rib elements thereof, to some degree at least, makes it less likely that grease and dirt will adhere to the support element.

Referring now to FIGS. 6 and 6A, details of a suitable latch mechanism for securing cover 40 to the housing 22 is illustrated. A spring element 60 is affixed to the housing 22 by a suitable fastener 62 and has an upturned end 64 which is positioned in a hole 66 formed in the cover at the top thereof to retain the cover in the closed position illustrated in FIG. 6. An aperture 70 is formed in the housing top. The aperture is of a size which is too small to accommodate a fingertip. If one wishes to open the latch it is necessary to insert a tool which has a diameter sufficiently small to enter the aperture and exert a downward pressure on spring element 64 which is in registry with the aperture.

If, however one wishes to facilitate access to the interior of the dispenser by making the latch mechanism fingertip actuatable, this can be accomplished quite readily by employing a pushbutton of the type shown in FIG. 6A and identified by reference numeral 80. Pushbutton 80, which may be formed of plastic or the like, has a stem segment 82 and an adjoining spring element engagement segment 84 which is divided by a notch 86. Segment 82 is freely slidable in aperture 70, however, the upper end of segment 84 is larger than aperture 70 and cannot pass therethrough when the pushbutton is in the unstressed condition shown in FIG. 6A.

Installation of the pushbutton is simplicity itself. It is simply pushed into place through the top of the aperture. The tapered shape of the spring element engagement portion 84 facilitates passage thereof through the aperture as does the existence of notch 86 which, of course, allows sufficient distortion of portion 84 for it to enter and pass through the aperture. Once the pushbutton is in place, delatching is simply a matter of pushing the button with a finger tip as shown by the arrow in FIG. 6A.

We claim:

1. In a dispenser apparatus including a housing and a cover for said housing, a latch mechanism for securing the cover in closed position relative to said housing, said latch mechanism including a movable element movable between a first position wherein the cover is locked in closed position to a second position wherein the cover is unlocked, an opening defined by either said housing or said cover in registry with said latch mechanism movable element, a pushbutton slidably mounted in said opening engageable with said latch mechanism movable element to move said latch mechanism movable element from said first position to said second position, said pushbutton having a stem segment extending through said opening and an adjoining segment between said opening and said latch mechanism movable element, said adjoining segment being deformable and of a size and configuration allowing passage thereof through said opening in one direction and preventing passage thereof through said opening in an opposite direction, said movable element comprising a spring element having a movable free end, said opening being in registry with said spring element at a location on said spring element spaced from said fastener means, said pushbutton adjoining segment being engageable with said spring element and including at least one notch formed therein to allow deformation of said pushbutton adjoining segment to facilitate passage thereof through said opening in said one direction.

2. The latch mechanism according to claim 1 wherein said stem element is of a size and configuration allowing freedom of movement of said stem element within said opening.

3. The latch mechanism according to claim 2 wherein said adjoining segment is tapered and has an end connected to said stem segment which is larger than said opening.

4. The latch mechanism according to claim 3 wherein said pushbutton is of unitary construction.

* * * * *